US009776444B2

(12) United States Patent
Hatton

(10) Patent No.: US 9,776,444 B2
(45) Date of Patent: Oct. 3, 2017

(54) SECURITY DEVICE

(71) Applicant: DE LA RUE INTERNATIONAL LIMITED, Basingstoke, Hampshire (GB)

(72) Inventor: Jan Adrian Robert Hatton, Burghfield Common (GB)

(73) Assignee: DE LA RUE INTERNATIONAL LIMITED, Hampshire (GB)

( * ) Notice: Subject to any disclaimer, the term of this patent is extended or adjusted under 35 U.S.C. 154(b) by 0 days.

(21) Appl. No.: 14/653,326

(22) PCT Filed: Dec. 16, 2013

(86) PCT No.: PCT/GB2013/053305

§ 371 (c)(1),
(2) Date: Jun. 18, 2015

(87) PCT Pub. No.: WO2014/096794

PCT Pub. Date: Jun. 26, 2014

(65) Prior Publication Data

US 2015/0343829 A1 Dec. 3, 2015

(30) Foreign Application Priority Data

Dec. 18, 2012 (GB) ..... 1222813.6

(51) Int. Cl.
*B41M 3/14* (2006.01)
*B42D 25/342* (2014.01)
(Continued)

(52) U.S. Cl.
CPC ..... *B41M 3/144* (2013.01); *B41M 3/148* (2013.01); *B42D 25/29* (2014.10); *B42D 25/324* (2014.10);
(Continued)

(58) Field of Classification Search
None
See application file for complete search history.

(56) References Cited

U.S. PATENT DOCUMENTS 7,738,173 B2 * 6/2010 Schilling ..... G02B 5/1866 359/567
7,906,198 B2 * 3/2011 Wicker ..... B41M 3/146 283/72

(Continued)

FOREIGN PATENT DOCUMENTS

| | | | |
|---|---|---|---|
| CA | 1019012 | A1 | 10/1977 |
| WO | 95/13597 | A2 | 5/1995 |
| WO | 2004/050376 | A1 | 6/2004 |

OTHER PUBLICATIONS

Mar. 25, 2014 International Search Report issued in International Patent Application No. PCT/GB2013/053305.

*Primary Examiner* — Laura Powers
(74) *Attorney, Agent, or Firm* — Oliff PLC

(57) ABSTRACT

A security device including an array of lines printed or otherwise provided on a substrate, the lines including materials which have the same appearance under visible light illumination but which appear different from each other in the visible under a combination of visible and non-visible, ultraviolet illumination. At least some of the lines in the array appear different from other lines under the combination of visible and non-visible, ultraviolet illumination. A second, surface relief array of lines imposed on the first array, the orientation, line widths and spacings of the first and second arrays being such that the device exhibits a variable appearance as it is tilted while exposed to the combination of visible and non-visible illumination.

31 Claims, 7 Drawing Sheets

(51) Int. Cl.
*B42D 25/324* (2014.01)
*B42D 25/387* (2014.01)
*B42D 25/29* (2014.01)

(52) U.S. Cl.
CPC ..... *B42D 25/342* (2014.10); *B42D 25/387* (2014.10); *B42D 2035/16* (2013.01); *B42D 2035/34* (2013.01); *B42D 2035/50* (2013.01)

(56) References Cited

U.S. PATENT DOCUMENTS

2007/0006127 A1* 1/2007 Kuntz ..... B41M 3/144
717/104
2012/0174447 A1 7/2012 Vincent

* cited by examiner

SECURITY DEVICE

The invention relates to a security device for use in securing documents and other articles of value such as banknotes, cheques, bonds, certificates, fiscal stamps, tax stamps, vouchers and brand protection items.

A particular class of security device, known as a "level 2" device is one which is not readily apparent to the unskilled observer thus providing some initial protection against counterfeiting. However, when the device is viewed by a knowledgeable observer, the security feature can be identified if it is present. An example of such a feature is described in WO-A-2004050376 which describes a device having two or more regions, each region containing a material or combination of materials which exhibit substantially the same visible appearance under first viewing conditions such as visible light, and different visible appearances under second viewing conditions, for example when viewed under UV or infrared radiation. This device has proved very successful and has been difficult to counterfeit. However, there is an ever increasing need to improve the security of such devices and in accordance with the present invention, we have developed a new security device comprising an array of lines printed or otherwise provided on a substrate, the lines comprising materials which have the same appearance e.g. colour under visible light illumination but which appear different from each other in the visible wavelength range under a combination of visible and non-visible, ultraviolet illumination whereby at least some of the lines in the array appear different from other lines under the combination of visible and non-visible, ultraviolet illumination; and a second, surface relief array of lines imposed on the first array, the orientation, line widths and spacings of the first and second arrays being such that the device exhibits a variable appearance as it is tilted while exposed to the combination of visible and non-visible illumination.

The invention adds further security to the known device by introducing a hidden optically variable feature into the device which is created by the registration between the surface relief array and the first array, and secondly because the presence of this additional effect is not readily discovered by the observer even when the device is illuminated under the combination of visible and UV illumination.

The "visible wavelength range" is typically from about 390 nm to 700 nm.

The first array may be provided in a wide variety of different forms. In a simple example, the first array comprises an array of parallel lines and these could be rectilinear lines or curvilinear lines, for example concentric circles, spirals, wavy lines and the like.

The lines of the first array are typically continuous and, for example, have a constant thickness, but can also be discontinuous. For example, the lines could be made up of spaced apart dots, alphanumeric symbols or other indicia providing yet a further security feature when the device is viewed under magnification. Further these dots or the like can be arranged in an orthogonal or other regular polygonal grid.

In a particularly preferred example, the materials providing the lines of the first array are chosen such that each line in the first array exhibits a different colour from its neighbouring lines under the combination of visible and non-visible illumination. Typically, these colours will alternate across the array from line to line. However, many other possibilities are possible. For example, more than one adjacent line could be made of the same material and thus respond in the same way to the combination of visible and non-visible UV illumination or different portions of the same line may exhibit different visible colours under the combination of visible and non-visible UV illumination.

In a further example, some of the lines of the first array may exhibit the same colour under both visible illumination and the combination of visible and non-visible, UV illumination with other lines exhibiting a change.

The lines of the first array can be provided preferably by printing but could also be coated, sprayed or the like onto the substrate. In the case of printing, the preferred methods include lithography, offset letterpress, waterless lithography, direct letterpress, rotogravure, flexographic printing and screen printing.

When the lines of each array are parallel, the lines of the second array typically correspond to the lines of the first array with, for example, adjacent sides of the relief being provided with a respective line of the first array. However, adjacent sides of the second array could be provided with more than one line of the first array. It is preferable that the repeat distance (i.e. pitch) of the lines of the same colour under a combination of visible and non-visible UV illumination of the first array is substantially the same as the repeat distance (i.e. pitch) of the second array. However, a difference in pitch of up to 15 or 30% is acceptable. It is not essential that the position of the different coloured lines under a combination of visible and non-visible UV illumination is in accurate register with the relief of the second array. If the register can be controlled accurately then the colours observed and the angle at which the change is observed can be controlled. However if the required security feature is the simple presence of a colourshift on tilting the device then the accurate registration is not necessary.

The line widths of the surface relief structure are selected such that the structure is non-diffracting, i.e. greater than 10 microns. Preferably the line widths of the surface relief will be chosen to be similar to that of the pitch of the lines in the printed array i.e. preferably between 100-500 microns and even more preferably between 290-420 microns.

In some examples, the lines of the second array have a similar form (curvilinear or rectilinear) to the lines of the first array but in other, preferred examples the lines of the second array could be different from those of the first array. For example, the second array could be formed with curvilinear lines such as circles while the first array is formed of rectilinear lines.

Where the pitch or direction of the lines of the second array are not the same as the corresponding pitch or direction of the first array, it is possible to vary the dominant colour presented to the viewer when the image is tilted to create a moiré effect or patterning. This is preferably done by rotating the arrays or localized regions of the two arrays and the angle of rotation utilised between the two arrays depends on the nature of the optical effect required. The resultant moiré lines will be further apart the closer the angle of rotation is to zero while a rotation angle of approximately greater than 5° will lead to closely spaced moiré lines exhibiting a rapid colour change on tilting. In practice, a localized rotation is typically achieved by locally modulating the position of the lines of one of the arrays, for example the use of a wavy line in one of the arrays.

The pitch of the second array is typically constant but in some cases it can vary across the array and, for example, can increase in a regular manner. This leads to further patterning effects. For example, where the first array defines a simple arrangement of alternate lines presenting alternate colours under a combination of visible and non-visible illumination, varying the pitch of the second array having lines parallel to that of the first will cause a graduated colour shift effect to be observed when the device is tilted.

The second array is typically provided by means of embossing into the substrate, most conveniently achieved by blind intaglio embossing. Of course, other conventional embossing techniques could also be used.

So far we have described a device having a single first array and a single second array. In some examples, the device may further comprise a further second surface relief array of lines imposed on the first array, the lines of the further second array being laterally offset from the lines of the one second array. With this option, discrete areas of the first array are effectively defined by the second arrays and in a simple case will result in a dominant colour visible under the combination of visible and non-visible UV illumination at any particular angle being different in the areas of the two second arrays.

Although we have described the use of lines which appear the same when viewed under visible illumination, it is also possible to use lines which are invisible under visible illumination (but become visible under a combination of visible and UV illumination). If those invisible lines are also transparent any underlying colour or pattern would be visible.

The manner in which the lines appear different from each other under the combination of visible and non-visible UV illumination can be achieved in a variety of ways.

In one simple approach, some lines of the first array exhibit the same colour(s) under visible and combined visible and non-visible UV illumination while other lines exhibit a different colour from the said same colour.

In other examples, the colour of each line in the array of printed lines changes from its colour under visible light illumination to respectively different colours.

In most examples, each line will be formed of the same material throughout its length. However, in some preferred examples, some lines of the first array have different portions that appear different from each other under the combination of visible and non-visible UV illumination. As with the previous examples, some of these portions may not exhibit any change when illuminated under visible light and under a combination of visible and non-visible UV illumination while in other examples each portion exhibits colours which change between the two types of illumination.

In this specification, the reference to "visible light", "visible light illumination" or "visible illumination" means viewing under visible light which is preferably but not essentially white light, preferably CIE-standard Illuminant D65.

When viewing under the combination of visible and UV illumination, we mean typically viewing under primarily ultraviolet light provided by a UV light source, such as a UV black light, where the peak wavelength emission is below 380 nm. This should be contrasted with visible illumination due to ambient daylight which, if divided by energy, is typically composed of 44% visible light, 3% UV (with the Sun at is zenith) and the rest infrared.

Ultraviolet wavelengths lie in the range 235-380 nm while infrared radiation wavelengths lie in the range 750 nm-1 mm.

It will be understood that when viewing under the combination of visible light and UV, colours visible under visible light also contribute to the overall appearance of each line.

Materials suitable for use in the present invention include pigments or inks which are luminescent and/or photochromic. Preferably, the materials respond to any i.e. all wavelengths in the ultraviolet range but in some cases may respond to only certain wavelength(s) in those ranges.

Of course, each "material" forming a line may be constituted by a single component responsive to visible and UV illumination or by more than one such component (or no such component in the case where the line does not change appearance under the two different illumination conditions). In addition, each material can also incorporate other components or vehicle as in conventional inks.

Security devices according to the invention can be provided on or form part of any of the security documents and articles mentioned above and can also be provided as transferable labels on a carrier. The labels may be transparent to allow underlying indicia to be viewed.

Some examples of security devices according to the present invention will now be described with reference to the following drawings, in which:—

Figure 1:
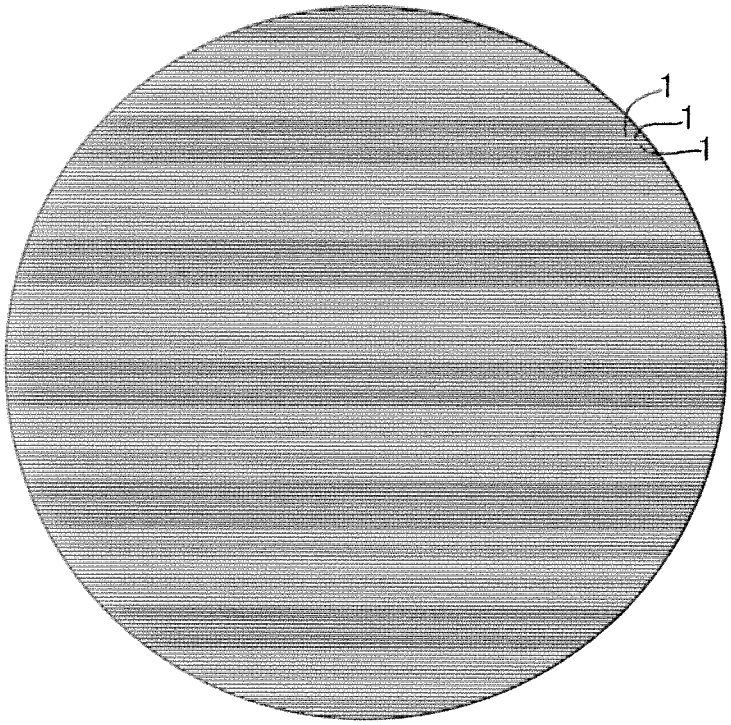
FIG. 1 illustrates the printed array component of a security device according to an example of the invention (without superimposed surface relief)
Figure 2:
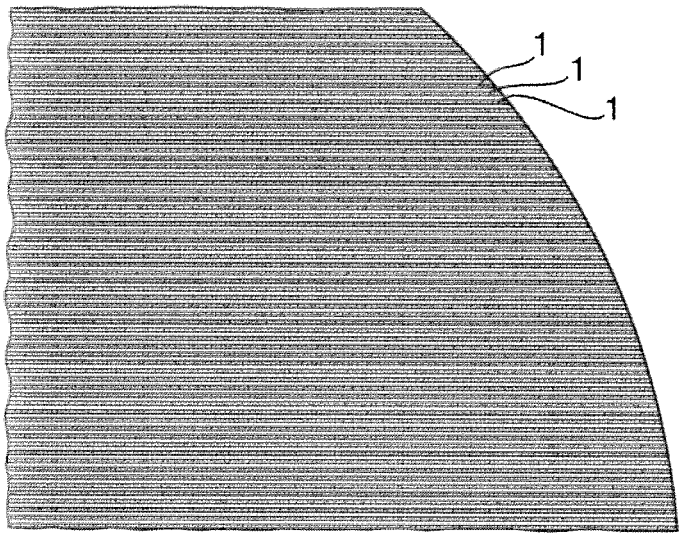
FIG. 2 is an enlarged view of part of FIG. 1.

FIG. 1 illustrates a printed circle made up of many rectilinear, equally spaced, parallel lines 1 which can be seen in more detail in FIG. 2. The lines 1 are each formed of one of two materials (each made up of one or more components), the two materials being used alternately, line by line, each material appearing blue under visible light. Under a combination of white light or daylight (preferably D65) and UV irradiation at 365 nm, adjacent lines 1 will appear with different visible colours due to the presence of a luminescent component in one of the two materials. Without any further changes to the device structure, these colours will combine when viewed by the naked eye to present an overall constant colour different from the colour of the device under visible radiation, typically white light.

Figure 3:
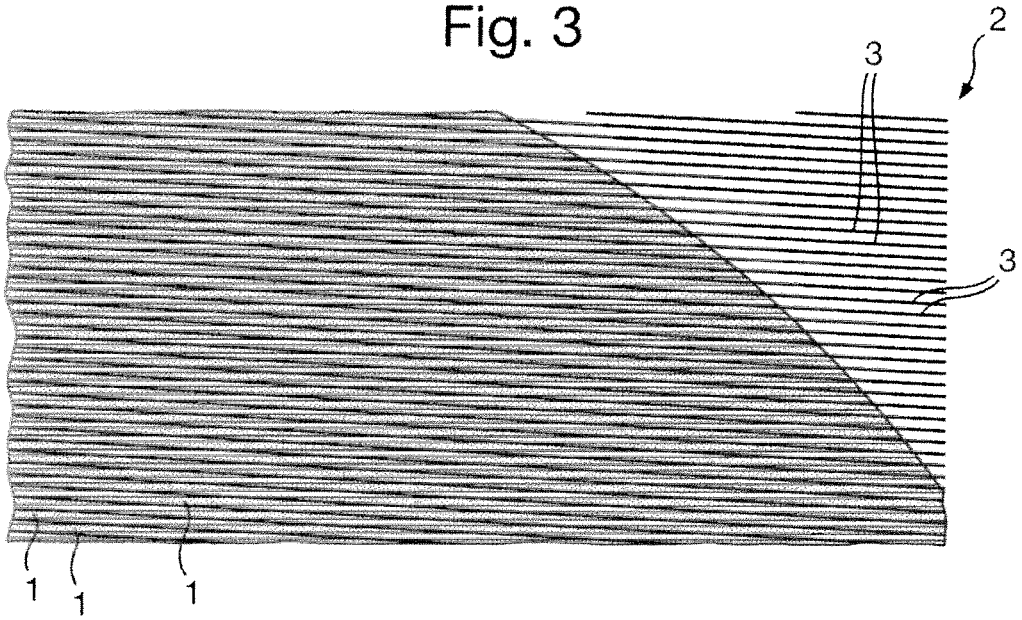
FIG. 3 is an enlarged view of the security device formed by the printed array of FIG. 1 superimposed with a surface relief structure when viewed in visible light and perpendicularly, the moiré lines being a defect of the reproduction in this image.

In order to bring out this difference in colours, the printed line array of FIGS. 1 and 2 is intaglio embossed to provide a surface relief second array 2 of lines 3 as can be seen in FIG. 3 illustrating the appearance of the device under white light illumination. The lines 3 are rectilinear and parallel as can be seen in FIG. 3 and are superimposed upon the printed line pattern 1. The pitch of the surface relief lines 3 is the same as that of the printed lines 1 but the array 2 is located at a non-parallel angle with the array 1 producing a moiré effect.

Figure 4:
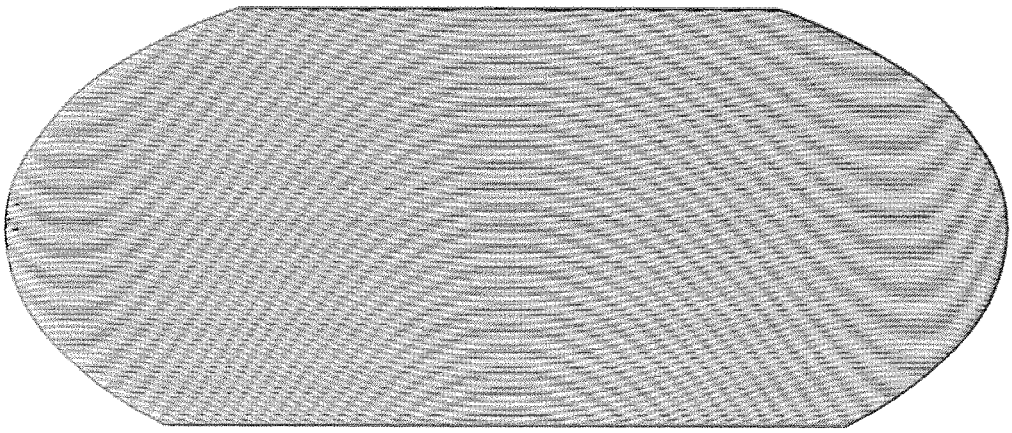
FIG. 4 illustrates the device of FIG. 3 when viewed under a combination of white light and ultraviolet illumination and at a non-perpendicular angle.

When the device shown in FIG. 3 is then exposed to a combination of UV (at 365 nm) and white light illumination, a colour change will result as mentioned above but otherwise when viewed perpendicularly the appearance will be the same as that shown in FIG. 3. However, when the device is tilted along an angle in a plane generally perpendicular to the lines 3, alternate ones of the lines 1 will be partly or completely concealed with the result that the colour of the other lines will become more dominant, likewise when the device is tilted in the opposite direction but again along an angle in a plane generally perpendicular to the lines 3 the situation will reverse and the other colour will become dominant resulting in the device changing on tilting. The rotation of the two arrays results in different dominant colours being present at the same angle of tilt at different regions in the device and also a moiré effect will be seen as shown in FIG. 4 resulting in the presence of coloured moiré fringes of different colours which appear as the device is tilted.

Figure 5A:
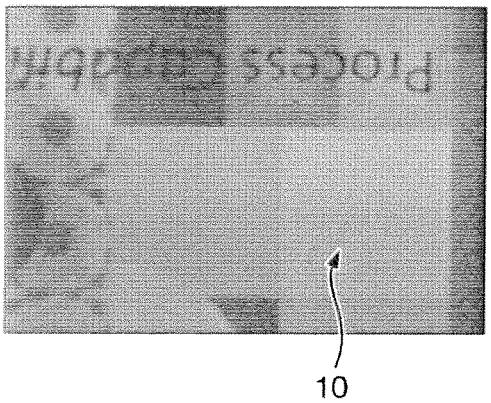
FIGS. 5A and 5B illustrate another example of a device at different tilt angles and when viewed under a combination of white light and ultraviolet illumination.
Figure 5B:
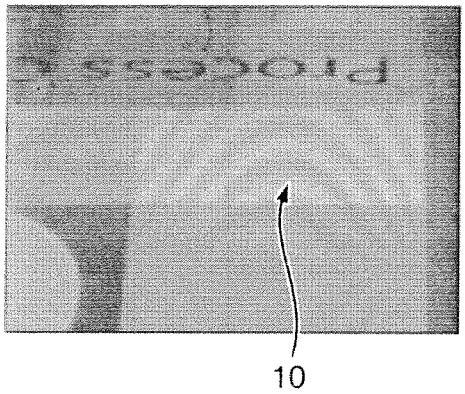

FIG. 5 illustrates part of a banknote or other security document including a device of the type shown in FIGS. 1-4, when viewed under a combination of white light and UV at 365 nm. FIG. 5A shows the device at 10 when viewed perpendicularly to the surface of the document while FIG. 5B shows the device when viewed at an angle with the moiré pattern becoming very clear.

Figure 6:
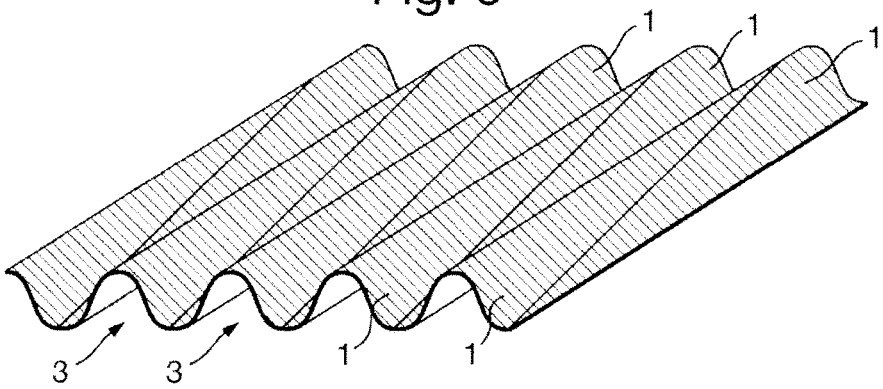
FIG. 6 is a schematic, enlarged view of the device of FIGS. 1-3 when viewed at a non-perpendicular angle under white light.

In order to understand the reason why this effect is being achieved, FIG. 6 illustrates the device described above in connection with FIGS. 1-4 in very enlarged and schematic form. Here the blue lines 1 can be seen extending at an angle to the regular, undulating surface relief lines 3. This is seen when viewed under white light, i.e. daylight or visible illumination.

Figure 7:
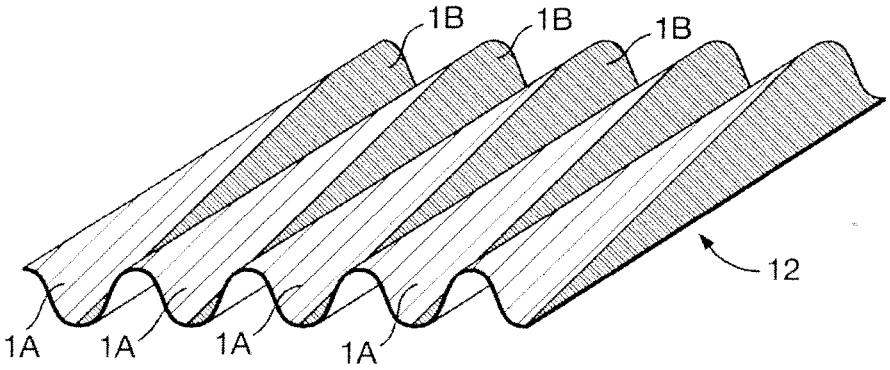
FIG. 7 is a view of the device shown schematically in FIG. 6 under a combination of white light and ultraviolet light.

When the same structure is viewed (FIG. 7) under a combination of white light and ultraviolet (365 nm), it can be seen that one of the sets of lines 1 changes to a first colour, in this case green (1A), while the other set of lines 1B changes to red. It can then be understood that when the device is tilted while looking along the direction 12 perpendicular to the direction of the embossed lines 3, different colours will be dominant and in different lateral positions (green to the left and red to the right) leading to a stripe effect.

In a simpler example, the sides or flanks of the surface relief lines 3 will be provided entirely with one or other of the lines 1, i.e. the two sets of the lines are parallel so that when viewed under a combination of white light and ultraviolet illumination, as the device is tilted and viewed along the direction 12, a gradual switch between one colour (the combination of colours) and the other (red or green) will be observed.

Figure 8:
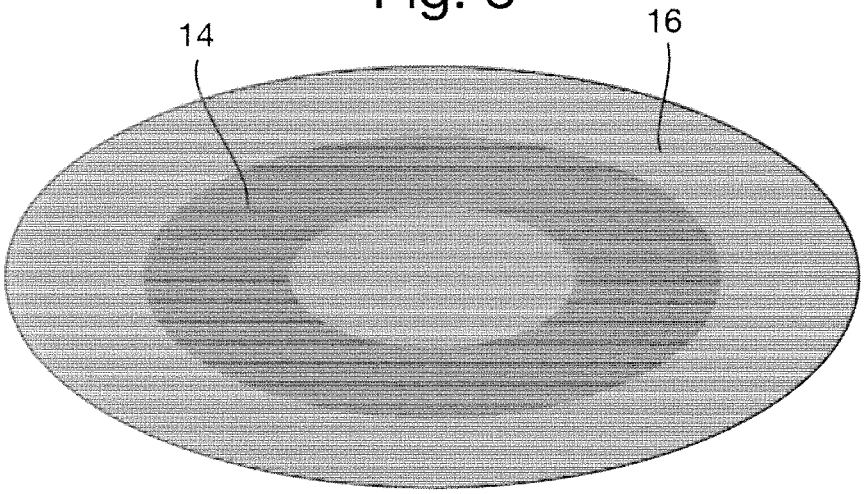
FIG. 8 is a view of a second example of a security device according to the invention when viewed under a combination of white light and ultraviolet light at a non-perpendicular angle.
Figure 9:
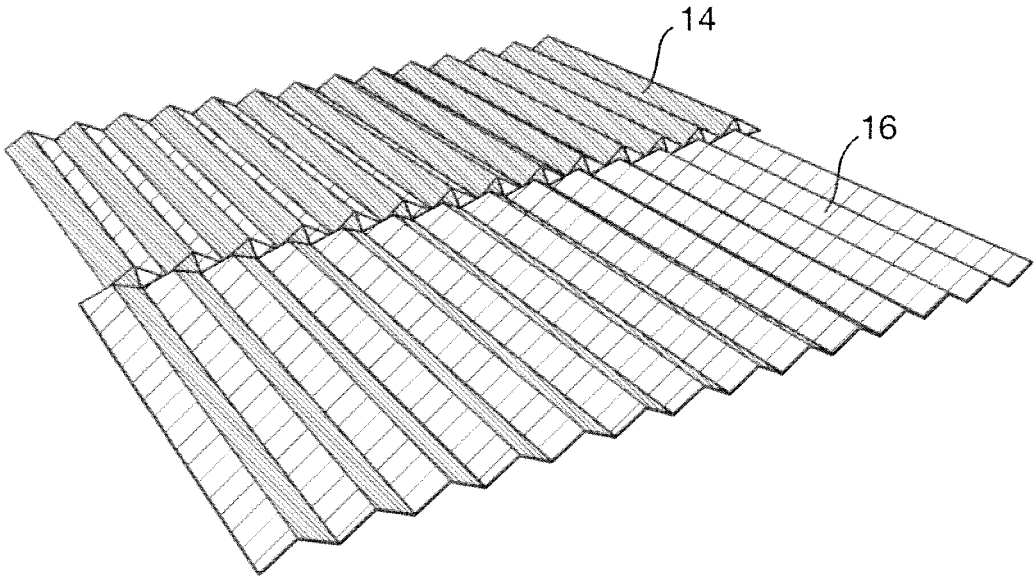
FIG. 9 is a considerably enlarged, diagrammatic view of part of the device shown in FIG. 8.

FIGS. 8 and 9 illustrate the principle of a second example. In this case, the printed array of lines shown in FIG. 1 is embossed with two surface relief structures of similar form side by side but offset with respect to one another so that the peaks of the surface relief of one array correspond to the troughs of the other. In this case, the surface reliefs 14,16 extend through circular regions (as seen in FIG. 8). Once again, when viewed under visible illumination, a flat colour will be observed. When viewed under a combination of visible and non-visible illumination (e.g. UV), the lines 1 will exhibit a colour change as described above but because of the offsetting of the surface reliefs 14,16, in one area of the device one of the resultant colours will be dominant (such as red) while in the other region the other colour will be dominant (such as green) when the device is viewed at a non-perpendicular angle.

It will be appreciated that many different variations of effect can be achieved by varying the form, pitch and location of the different arrays.

In typical examples, the pitch of the lines 1 in the printed array will be between 290 microns and 420 microns, the closer the lines are together the flatter the resultant colour when viewed under visible illumination. Typically, a spacing between lines is allowed of up to 45 microns such that for a two colour design, i.e. alternating lines of different colours under a combination of visible and non-visible illumination and a repeat of 290 microns, leads to a line width of about 100 microns.

The line widths of the surface relief will be chosen to be similar to that of the printed lines.

Figure 10A:
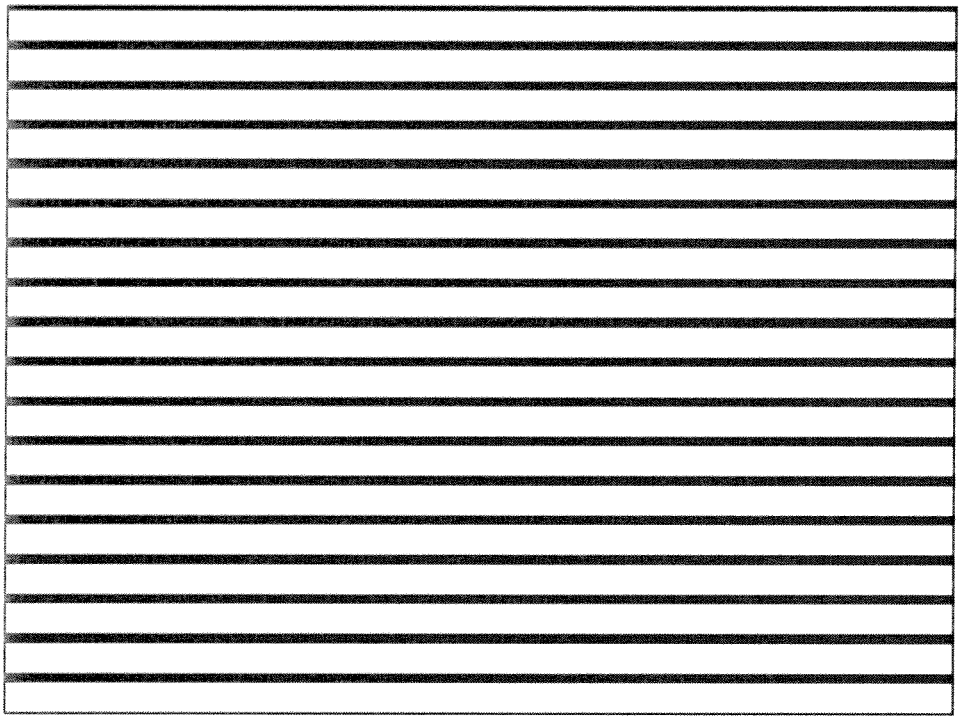
FIG. 10A illustrates one working of a printed array of a further example.
Figure 10B:
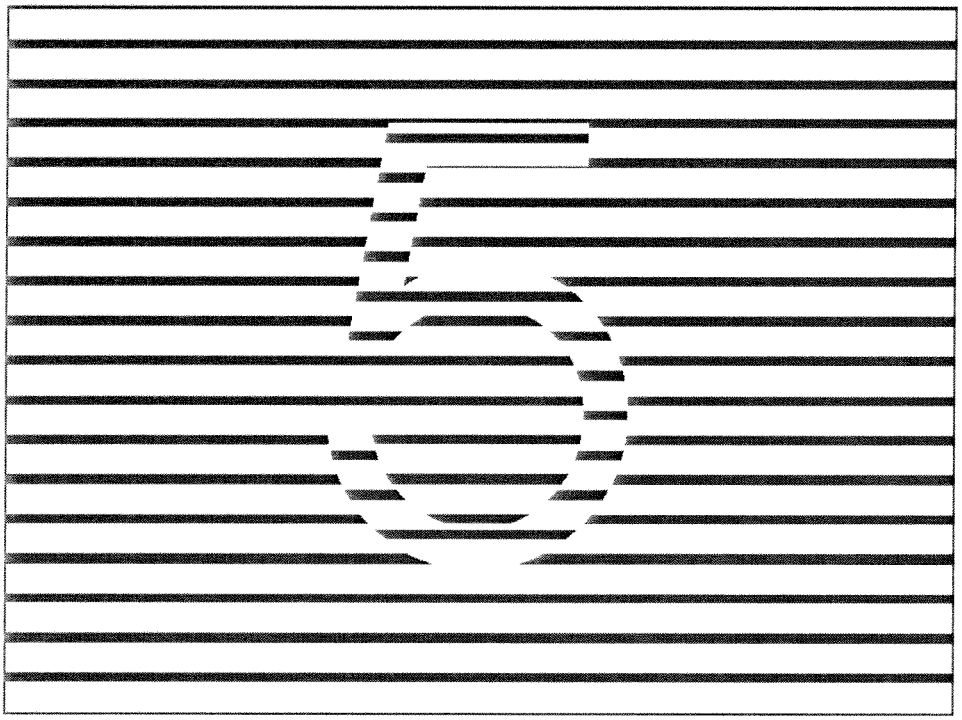
FIG. 10B illustrates a relief array to be imposed on the array of FIG. 10A.

FIG. 10A shows an example of part of the printed array used to produce the optical effect of the current invention. For simplicity only one of the printed workings is shown, however the printed array will comprise alternating lines of two different materials as described for FIG. 1. The array of lines with the surface relief is shown in FIG. 10B and has the same rectilinear profile as the printed arrays. The array of lines with the surface relief has a region 20 in the shape of a numeral "5" which is offset from the background so that the peaks of the surface relief of the offset region correspond to the troughs of the background region. Once again, when the combined arrays defining the security device are viewed under visible illumination, a flat colour will be observed. When viewed under a combination of visible and non-visible, UV illumination, the lines 1 will exhibit a colour change as described above but because of the offsetting of the surface reliefs, the numeral "5" will have a different dominant colour compared to the background when the device is viewed at a non-perpendicular angle. In this example the relief lines have a repeat of 185 μm and a 285 μm line pitch (Centre to Centre). The two differing lines of the printed arrays have a line width of 125 μm with a 25 μm spacing between each line giving a line pitch for a line of each material of 300 μm (Centre to Centre). In this example there is no angular rotation and the moiré effect is negligible.

Figure 11A:
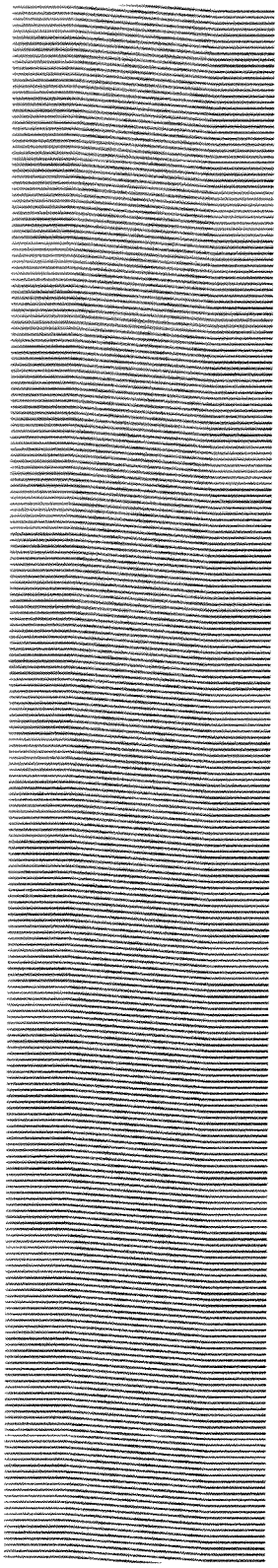
FIG. 11A illustrates one working of a printed array of yet a further example.
Figure 11B:
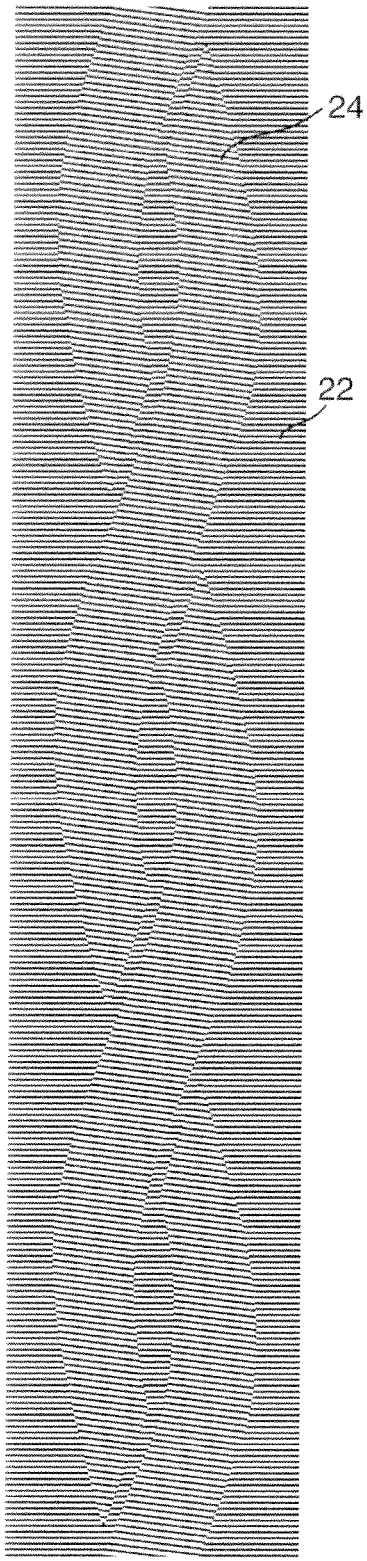
FIG. 11B illustrates a relief array to be imposed on the array of FIG. 11A.

FIG. 11A shows a further example of part of the printed array used to produce the optical effect of the current invention. For simplicity only one of the printed workings is shown, however the arrays will comprise alternating lines of two different materials as described for FIG. 1. The array of printed lines (FIG. 11A) has a smooth wavy profile while the array of lines with surface relief (FIG. 11B) has a background region 22 which broadly follows the profile of the printed array but in a second region 24 the array of lines with a surface relief has been rotated by 7 degrees to form a spiral pattern. This effectively results in a rotation of 7 degrees between the array of lines with surface relief and the array of printed lines in the region of the spiral with the result being that a moiré effect is observed with differently coloured moiré bands appearing along the spiral as the device is tilted and viewed under a combination of visible and UV illumination. A colourshift effect will also be observed in both the spiral and background regions of the device when viewed under a combination of visible and UV illumination. In this example the line widths and repeats are the same as the FIG. 10 example.

Figure 12A:
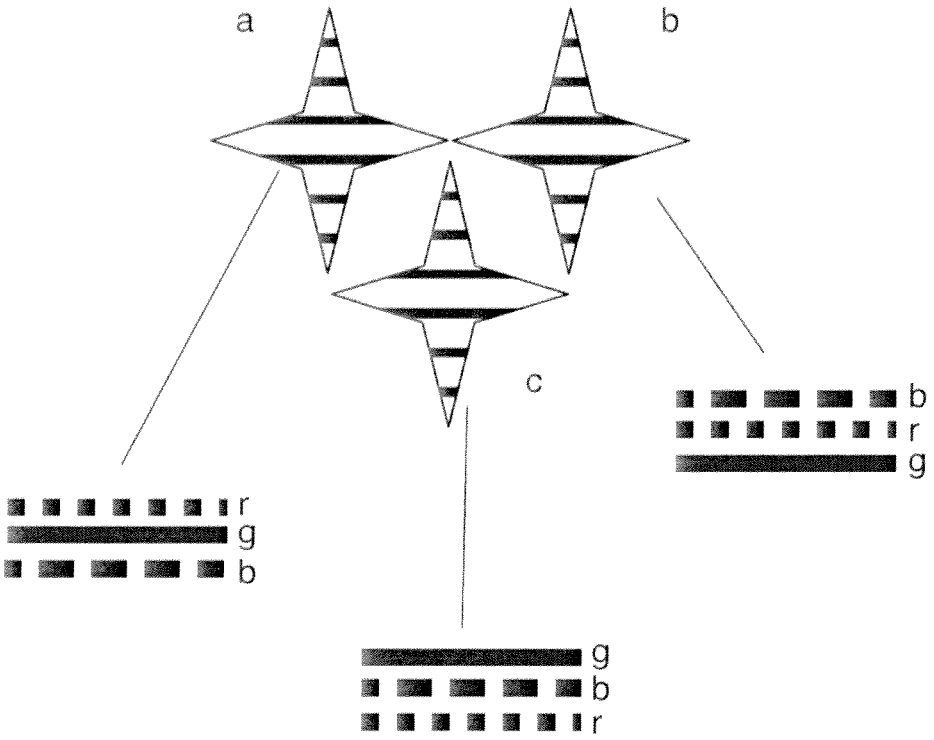
FIG. 12 illustrates one working of the printed array and the relief array of yet another example.
Figure 12B:
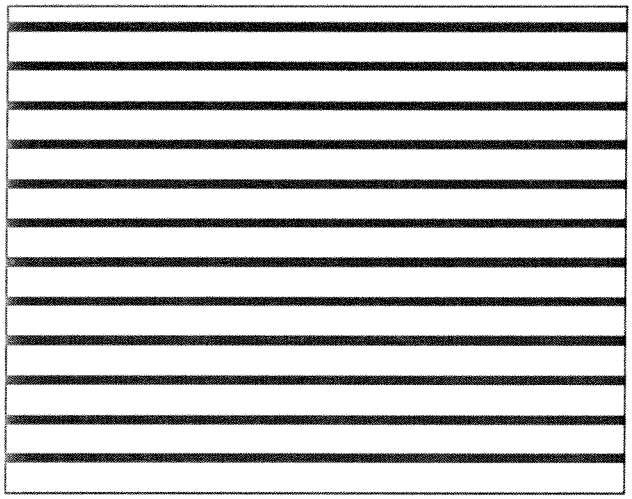

FIG. 12 shows a further example for the two arrays used to produce the optical effect of the current invention. For simplicity only one of the printed workings is shown (FIG. 12A), however the arrays will comprise repeating lines of three different materials. The printed array is divided into three sections, in this example forming three stars. In Star (a) the lines of printed array repeat in the order red-green-blue, for Star (b) the repeat order is blue-red-green and for Star (c) the repeat order is green-blue red. In each Star the array of printed lines has a rectilinear pattern. The array of lines with surface relief (FIG. 12B) has a similar rectilinear pattern which is uniform with no offset regions. The position of the differently coloured printed lines in relation to the peaks, troughs and flanks of the relief structure will vary for the different Stars and therefore a different colour will be seen in each Star as the device is tilted.

It is also possible to create a graduated colour shift instead of the patterns described above. This can be achieved by deliberately varying the pitch of the surface relief compared to that of the printed array using rectilinear lines and with the two sets of lines parallel. The degree of pitch variation affects how quickly the colours graduate.

Although the examples have been described in connection with illumination under UV light, as explained above, materials are also available which would allow the device to be fabricated so as to exhibit the desired response under a combination of visible illumination and infrared radiation.

An example of a pair of inks suitable for use in this invention are set out below. These inks appear the same (brown) under visible illumination (D65) but different (red and green respectively) from each other and from their colour (brown) under visible illumination when they luminesce under a combination of visible (D65) and ultraviolet radiation at 365 nm.

Brown Ink Luminescing Red

| | |
|---|---|
| Graphtol Yellow RGS (ex Clariant) | 6.1% |
| Graphtol Orange P2R (ex Clariant) | 1.3% |
| Permanent Carmine FBB02 (ex Clariant) | 3.4% |
| Paliogen Black L0084 (ex BASF) | 4.9% |
| Lumilux Red CD740 (ex Honeywell) | 25% |
| Lithographic printing ink vehicle | 39% |
| Antioxidant | 1% |
| Cobalt Driers | 0.7% |

Brown Ink Luminescing Green

| | |
|---|---|
| Graphtol Yellow RGS (ex Clariant) | 6.1% |
| Graphtol Orange P2R (ex Clariant) | 1.3% |
| Permanent Carmine FBB02 (ex Clariant) | 3.4% |
| Paliogen Black L0084 (ex BASF) | 4.9% |
| Scanning Compound 4 (ex Angstrom Technologies) | 25% |
| Lithographic printing ink vehicle | 39% |
| Antioxidant | 1% |
| Cobalt Driers | 0.7% |

Although the examples so far have used inks which both change colour in response to illumination by a combination of white light and UV radiation, in other examples, one ink may exhibit the same colour under both types of illumination while the other changes colour. An example of a suitable ink pair is:

Purple Ink—Non Luminescent

| | |
|---|---|
| Sandorin Violet BL (ex Clariant) | 0.78% |
| Permanent Carmine FBB02 (ex Clariant) | 2.58% |
| Lithographic printing ink vehicle | 95% |
| Antioxidant | 1% |
| Cobalt driers | 0.64% |

Purple Ink Luminescing Yellow

| | |
|---|---|
| Sandorin Violet BL (ex Clariant) | 0.78% |
| Permanent Carmine FBB02 (ex Clariant) | 2.58% |
| Scanning Compound 6 (ex Angstrom Technologies) | 30% |
| Lumilux Red CD740 (ex Honeywell) | 2.5% |
| Lithographic printing ink vehicle | 62.5% |
| Antioxidant | 1% |
| Cobalt Driers | 0.64% |

Although the examples described have been formed as continuous, printed lines, for example litho printed, many other options are available as mentioned above. For example, the lines could be discontinuous and formed of dots, indicia and the like. In addition, the lines have been shown to change completely to a second colour under ultraviolet radiation while in other examples, the lines could be divided into different portions which exhibit different colours under a combination of visible and UV illumination.

Examples of suitable inks that are invisible under visible (daylight) illumination but exhibit visible colours under a combination of visible and UV illumination are described in WO-A-9840223 and WO-A-0078556.

The invention claimed is:

1. A security device comprising:

a first array of first and second pluralities of lines on a substrate, the first and second pluralities of lines comprising respectively different materials that have the same visible appearance with respect to colour under visible light illumination, the material(s) of the first plurality of lines or portions of the first plurality of lines comprising luminescent and/or photochromic pigments such that the first plurality of lines or portions of the first plurality of lines appear visibly different in colour to the second plurality of lines under a combination of visible light and ultraviolet illumination; and a second array of lines imposed on the first array, the orientation, line widths and spacings of the first and second arrays being such that the device exhibits a variable, visible appearance with respect to colour as it is tilted while exposed to the combination of visible and ultraviolet illumination.

2. The security device according to claim 1, wherein the first and second pluralities of lines of the first array comprises an array of parallel lines.

3. The security device according to claim 1, wherein the first and second pluralities of lines of the first array comprises an array of rectilinear lines.

4. The security device according to claim 1, wherein the first and second pluralities of lines of the first array comprises an array of curvilinear lines.

5. The security device according to claim 1, wherein the first and second pluralities of lines of the first array are discontinuous.

6. The security device according to claim 5, wherein the first and second pluralities of lines are formed by spaced apart dots, alphanumeric symbols, or other indicia.

7. The security device according to claim 6, wherein the dots, alphanumeric symbols or other indicia forming the first array are located in an orthogonal or other regular polygonal grid.

8. The security device according to claim 1, wherein at least one line of the first plurality of lines in the first array has portions that appear visibly different from each other with respect to colour under the combination of visible light and ultraviolet illumination.

9. The security device according to claim 1, wherein each line of the first and second pluralities of lines in the first array exhibits a different colour from its neighbouring line under the combination of visible light and ultraviolet illumination.

10. The security device according to claim 1, wherein each line of the first and second pluralities of lines in the first array exhibits a respective one of two colours under the combination of visible light and ultraviolet illumination so that the colours of the lines alternate across the array.

11. The security device according to claim 1, wherein the first and second pluralities of lines of the first array appear different under the combination of visible light and ultraviolet illumination because they appear opaque and transparent respectively.

12. The security device according to claim 1, wherein the first array is printed on the substrate.

13. The security device according to claim 12, wherein the first array has been printed by one of litho, offset letterpress, waterless lithography, direct letterpress, rotogravure, flexographic printing and screen printing.

14. The security device according to claim 1, wherein the second array comprises rectilinear lines that are typically parallel.

15. The security device according to claim 1, wherein the second array comprises curvilinear lines.

16. The security device according to claim 1, wherein the lines of the second array are not parallel with the first and second pluralities of lines of the first array.

17. The security device according to claim 1, wherein the lines of the first and second pluralities of lines of the first array are equally spaced apart.

18. The security device according to claim 1, wherein the lines of the second array are equally spaced apart.

19. The security device according to claim 17, wherein the pitch of the lines of the second array is different from the pitch of the first and second pluralities of the lines of the first array.

20. The security device according to claim 1, wherein the pitch of the lines of the second array varies across the array.

21. The security device according to claim 20, wherein the pitch of the lines of the second array increases in a regular manner across the array.

22. The security device according to claim 1, wherein the line widths of the second array are greater than 10 microns.

23. The security device according to claim 1, wherein the pitch of the first and second pluralities of lines of the first array is in the range 100-500 microns.

24. The security device according to claim 1, wherein the pitch of the lines of the second array is in the range 100-500 microns.

25. The security device according to claim 1, further comprising a third array of lines imposed on the first array, the lines of the third array being laterally offset from the lines of the one second array.

26. The security device according to claim 25, wherein the pitches of the second and third arrays are the same, the lines of the second array being aligned with spaces between the lines of the third array.

27. The security device according to claim 25, wherein the second and third arrays are rotated at least in localised regions to generate the moiré effect.

28. The security device according to claim 1, wherein the first array comprises a plurality of laterally spaced sections, the lines in each section, when viewed under the combination of visible light and ultraviolet illumination, exhibiting a respectively different sequence of the same group of colours.

29. The security device according to claim 28, wherein the laterally spaced sections have similar shapes.

30. The security device according to claim 1, provided as a transferable label on a carrier.

31. A document incorporating the security device according to claim 1 or on which such a security device has been affixed.

* * * * *